United States Patent [19]

Parlagreco

[11] 3,939,851

[45] Feb. 24, 1976

[54] SINGLE STEP HAIR CURLER WITH INDEPENDENT SELF-CONTAINED SUPPORTING AND SECURING MEANS

[76] Inventor: Thomas J. Parlagreco, 5 Ferris Court, Ho-Ho-Kus, N.J. 07423

[22] Filed: Apr. 9, 1974

[21] Appl. No.: 459,289

[52] U.S. Cl. ..... 132/34 R
[51] Int. Cl.[2] ..... A45D 2/12
[58] Field of Search ..... 132/34, 40, 42, 37, 55

[56] References Cited

UNITED STATES PATENTS

| | | | |
|---|---|---|---|
| 2,248,683 | 7/1941 | Kroff | 132/34 R |
| 2,796,872 | 6/1957 | Mussy | 132/40 |
| 3,419,019 | 12/1968 | Hoffmann et al. | 132/41 |
| 3,696,820 | 10/1972 | Lara | 132/40 |

FOREIGN PATENTS OR APPLICATIONS

| | | | |
|---|---|---|---|
| 571,752 | 10/1958 | Belgium | 132/40 |

*Primary Examiner*—G. E. NcNeill
*Attorney, Agent, or Firm*—Ralph R. Roberts

[57] ABSTRACT

This invention pertains to a hair curler having a roller rotatably mounted on end supports whose base portions are adapted to rest on the head of the user. Each end support operates independently of the other and one or both includes a self-contained securing tension mechanism in the form of a ratchet device. This ratchet device in no way restricts the winding of hair around the roller portion of the curler assembly. After a section of hair has been wound around the roller, the base of the rotatable end support is positioned on the head and the roller remains in this condition with the end support sustaining the curler while retaining the hair wound thereon until the desired drying, styling or curling effect of the hair has been achieved. The base of the end support is constructed in such a proportioned manner that the support retains and restricts movement of the hair roller from the prescribed and seated position on the user's head. The roller can be easily disengaged from this position by tipping the roller over and releasing the tension thereby enabling the user to unwind the hair. Both internal and external independent, self-contained supporting, securing and tension mechanisms are shown. These include ratchet devices as well as an insertable support ratchet end member which may be utilized in conjunction with conventional hair curlers and/or rollers now known to the trade.

9 Claims, 5 Drawing Figures

SINGLE STEP HAIR CURLER WITH INDEPENDENT SELF-CONTAINED SUPPORTING AND SECURING MEANS

BACKGROUND OF THE INVENTION

1. Field of the Invention

With reference to the classification of art as established in the U.S. Patent Office the present invention pertains to art found in the general Class entitled, "Toilet" (Class 132) and in the subclasses thereunder of "crimpers or curlers" (subclass 31) and more particularly to "winding forms or mandrels" (subclass 33) and also "with rotating means" (subclass 34).

2. Description of the Prior Art

Hair rollers and curlers, of course, are well known and particularly those of plastic wherein all kinds of clamping attachments, securing devices and hair tension methods are employed. The present invention pertains to a hair roller having rotatable supports on each end operating independently of each other. Each roller end is adapted to rest upon the head of the user while the roller member between these supports is rotated to wind the selected portion of hair thereon. One or both of these support ends of the roller has a self-contained securing and tension mechanism in the form of a ratchet device. The ratchet intervals are spaced so that when the desired tightness and/or tension of the hair wound around the roller is reached the rotating of the roller by the user is stopped. The roller remains fixed in position permitting the hair to dry with the desired tightness and/or tension and in the selected diameter of curl as established by the size of the roller. The single step hair curler of this invention uses no additional members such as pivotally attached clips or as with other rollers spring clip retainers which are pushed into place after the hair is wound on the roller.

SUMMARY OF THE INVENTION

This invention may be summarized at least in part with reference to its objects.

It is an object of this invention to provide, and it does provide, a hair roller having rotatably mounted end supports contoured and sized so that their bases are adapted to seat on the head of the user. One of both of the supports has a ratchet means associated with the roller to prevent rotation of the roller in the direction opposite to that which the hair is wound. Ratchet stops are spaced a few degrees apart so that the roller rotation may be stopped at or very near the desired tension.

It is an object of this invention to provide, and it does provide, a hair roller for rolling hair, said roller having a support rotatably attached to each end, the support being totally retained at the end of the roller. In conjunction with at least one support end there is provided a spring-type ratchet finger. This ratchet finger is adapted to engage a one way ratchet gear carried by the roller.

It is a further object of this invention to provide, and it does provide, an inexpensive hair roller in which a ratchet and support are carried on at least one end of the roller, this support adapted to rest upon the head of the user while the roller is being rotated around a pivot carried by the support. A toothed ratchet gear is carried by the roller and is engaged by a ratchet pawl carried by the support so that the roller may be rotated in only one direction. The roller remains in the rotated condition on the head after the determined amount of turns of the roller have been made by the user. The ratchet gear is engaged by the pawl on the support to prevent reverse rotation of the roller.

The hair curler of this invention is contemplated to be made of plastic with both the roller and end supports molded. In at least one end support there is provided a ratcheting means which carries a finger or an engaging lug adapted to engage a toothed ratchet provided on or carried by the roller. The ratchet has a substantial number of equally spaced teeth arranged circularly in either an internal or external ring. Preferably,rotatable ratchet supports are provided on both ends of the roller and absent the ratchet means the roller is freely rotatable around an axle associated with said support.

Three embodiments of the roller are shown, each embodiment providing substantially identical operation permitting the roller to be rotated in only one direction and with ratcheting means providing a stop for the winding of the roller at or within a very small degree of the desired amount of tension and rotation.

In addition to the above summary the following disclosure is detailed to insure adequacy and aid in understanding of the invention. This disclosure, however, is not intended to prejudice that purpose of a patent which is to cover each new inventive concept therein no matter how it may later be disguised by variations in form or additions of further improvements. For this reason there has been chosen three embodiments of the hair roller with end supports and showing three arrangements for the end supports and the one way ratcheting means used therewith. These embodiments have been chosen for the purpose of illustration and description as shown in the accompanying drawing wherein:

DESCRIPTION OF THE DRAWING

In the following description and in the claims various details will be identified by specific names for convenience. These specific identifications are intended to be generic in their application. Corresponding reference characters refer to like members throughout the five figures of the drawing.

Figure 1:
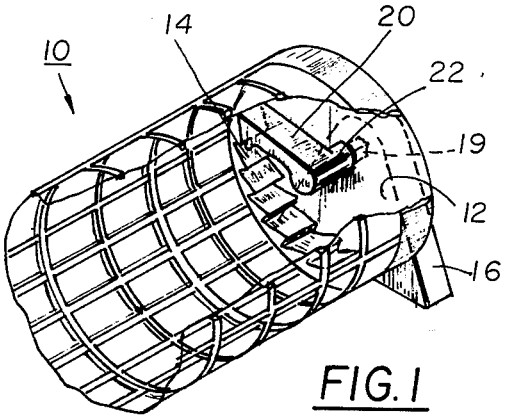
FIG. 1 represents a fragmentary isometric view of one end of the roller of this invention with a portion broken away to expose the ratchet construction of the roller end and ratchet supporting end member.

The drawing accompanying, and forming part of, this specification discloses certain details of construction for the purpose of explanation but it should be understood that structural details may be modified and that the invention may be incorporated in other structural forms than shown.

DESCRIPTION OF THE EMBODIMENT OF FIGS. 1 AND 2

Figure 2:
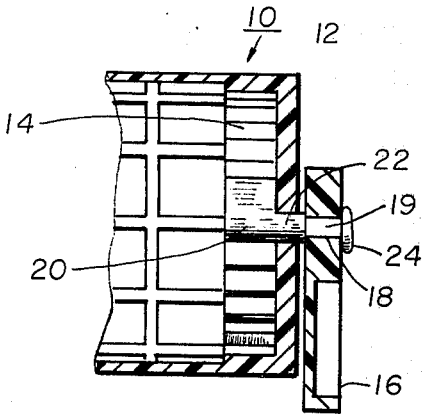
FIG. 2 represents a sectional view in a slightly enlarged scale of the end of the roller assembly of FIG. 1 and showing in detail the construction and assembly of this particular roller assembly.

Referring now in particular to the drawing and the roller embodiment as shown in FIGS. 1 and 2 there is depicted a conventional cylindrical hair roller member 10 having an open or mesh-type construction allowing circulation of air and also employing the minimum use of material. This roller is formed with a closed end 12 which carries on its inside periphery a series of ratchet teeth 14. These teeth are peripherally spaced in a circle around the interior of the roller end and are of a determined depth and preferably of equal spacing. A support block or end 16 has an aperture 18 therethrough and carried in this aperture is the shank 19 of a ratchet arm 20. This aperture 18 is formed as a rectangle or square and shank 19 is formed to be a tight locking fit in aperture 18. This ratchet arm 20 may be of plastic or the like and as retained by the rectangular or square shank portion is maintained in a fixed relationship to the bottom of the end member 16. A round shank portion 22 is formed and sized to be rotatable in an aperture in roller end 12 and permits free rotation of the roller 10 around this round shaft portion. The ratchet arm 20 is disposed to engage at its outward end the ratchet teeth 14 and as configured permits rotation in only one direction. The other end of the roller may be similary provided with a ratchet apparatus or may have a support 16 which is freely rotatable on a shaft portion carried by or in the support. The ends of the shank 19 may be heated to form a rivet head 24 to retain the shank 19 in the cooperatively formed socket 18.

USE OF THE ROLLER OF FIGS. 1 AND 2

In use the hair is stranded in the desired amount and the distal ends wound upon the basket portion 10 of the roller. The supports 16 are then caused to rest upon the head of the user and the roller is then tightened in the one way direction which the ratchet is designed to permit. When the desired winding of the roller and the hair thereon has been brought to the desired tension the user merely releases the roller with the end portions 16 still seated upon the head. The pawl end engages the adjacent ratchet stop which insures that the tightly wound hair and the roller remain in this tensioned position until the hair has reached the desired degree of dryness. To remove the roller from the hair and head the user merely lifts the roller slightly from the head an amount sufficient to allow the end member 16 to be turned from the seated position. A three-quarter unwinding turn of the roller permits the roller to be freely manipulated to unwind the hair in the conventional manner. Whether both ends of the roller 10 have ratchet means such as seen in FIGS. 1 and 2 is merely a matter of selection, however, once the molds have been made the additional material required for the ratchet stops provided by the molded teeth 14 and arms 20 are of little expense and it is contemplated that in most instances both ends of the roller will have a ratcheting arrangement and components.

DESCRIPTION OF THE EMBODIMENT OF FIGS. 3 AND 4

In the hair roller of FIGS. 1 and 2, above-described, the ratchet teeth 14 and the arm 20 are on the inside of the roller. As an opposite arrangement the roller assembly depicted in FIGS. 3 and 4 has the ratchet external of the roller end 30 and also may have the intermediate roller 31 provided as a lattice construction or a straight rib-type. The ratchet teeth 32 in this embodiment are arranged as an external ring on the end 30. The outward projection of the teeth is made as small as possible to prevent catching the hair in the teeth of the ratchet. An end member 36 is rotatably retained on and by the end of the roller by means of an axle 38 which may be riveted or otherwise secured in place. As shown, particularly in FIG. 3, the base 39 of end member 36 is made as a bowed spring. Molded intermediate the ends of the base portion 39 is a lug portion 40. This lug portion 40 extends inwardly to engage the teeth 32 of the ratchet gear on end 30 and is biased into this engaged position by this formed portion 39. This lug portion may have an outwardly extending portion to provide a finger engaging portion which is manipulated by the user to temporarily push the ratcheting lug portion 40 away from engagement of the teeth 32 of the ratchet gear.

USE OF THE ROLLER OF FIGS. 3 AND 4

In use this roller assembly as with the roller of FIGS. 1 and 2 requires the user to grasp the roller portion 31 and the ends of the hair and begin rotating the roller in one direction with the member 36 seated upon the user's head. When the desired amount of rotation of the roller has been achieved to wind the hair to the desired tension the user merely stops the rotation of the roller and with member 36 in seated condition upon the head the engaging lug or pawl 40 is allowed to engage the adjacent tooth of ratchet gear 32 to retain the roller 30 in the desired position. The roller 30 remains in this position on the user's head until the desired amount of drying has been achieved. When the roller 30 is to be removed the user with a finger manipulates the outwardly protruding portion of lug 40 to cause the pawl portion to disengage from the ratchet tooth gear and allow the roller to freely reverse turn with the hair on the roller unwinding until the tension is removed. The roller is then rotated until the hair is free of the roller. In this particular embodiment it is contemplated that the ratchet will be formed upon only one end of the roller with the other supporting end being absent a ratchet but still having a support similar in size and configuration to support 36 enabling the other end of the hair roller to seat upon t he user's head.

EMBODIMENT OF FIG. 5

Figure 5:
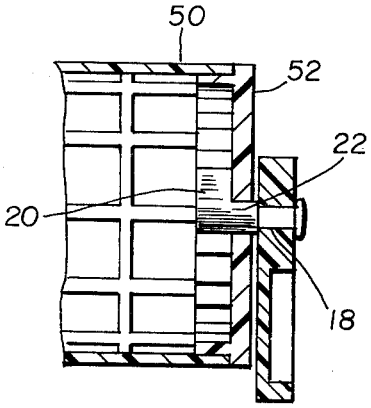
FIG. 5 shows an alternate arrangement whereby a conventional roller is fitted with a ratchet and support member to provide a roller assembly quite similar to the roller as seen in FIGS. 1 or 2.

Referring next and finally to FIG. 5, it is to be noted that many existing conventional rollers are made which have open ends. It may be desirable to utilize these already available rollers in the instant invention. It is assumed that these rollers are presently available and owned by the housewife. Toward that end it is contemplated that an end member such as that shown in FIGS. 1 or 3, instead of being molded as an integral portion of the roller assembly, will be made as an end assembly which will seat within and be mounted in the end of already existing and owned rollers. Attachment of these ratchet ends may be made by solvent or with other adhesive means. A heat press fit also may be used to achieve attachment. The use and operation of the roller assemblies is exactly as in the case of FIGS. 1 and 3, above-described.

As depicted, an end such as that of FIGS. 1 and 2 is mounted in a conventional roller. The existing conventional roller 50 is adapted to receive end plate 52 which is sized and shouldered to seat in and be attached to the end of roller 50. Teeth 14, support end 16 and ratchet arm 20 are assembled to end plate 52 as in FIG. 2 with the end 24 holding arm 20 in place. When mounted in an existing roller 50 the end 52 and associated components provide the desired ratcheting mechanism.

Figure 3:
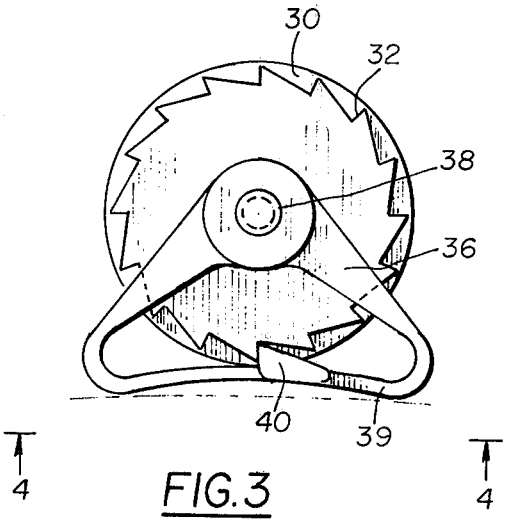
FIG. 3 represents an end view of an alternate roller assembly wherein the ratchet gear is carried on the external end of the roller and the pawl is carried as a protruding extension of a flexible base leg portion of the end support member.
Figure 4:
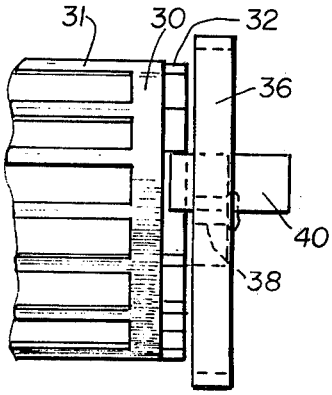
FIG. 4 represents a plan view taken on the line 4—4 of FIG. 3 and showing the relationship of the various components in the roller end of FIG. 3.

In like manner, the roller 50 could be mounted on an end assembly similar to that shown in FIGS. 3 and 4. The assembled roller would then operate and provide all the advantages of the roller of FIG. 3.

It is to be further contemplated that as an alternate construction the teeth of the ratchet gear might be formed on the end member and accordingly the cooperative pawl is carried by an end plate to which the roller is molded or otherwise secured. The pawl as thus arranged revolves with the roller while the teeth remain in a nonrotating fixed relationship to the support member.

It is also to be further contemplated that the ratchet and pawl assembly may be constructed so as to permit either way rotation against a detent means. Such a detent or ratchet system usually includes a pawl or plunger having more-or-less symmetrical configuration adapted to enter and engage equally sided and configured detent recesses. To maintain the detent plunger in an equally sided or angled recess usually requires a stiff spring action to maintain the seated position of the plunger. This would require a relatively stiff rotative motion to be employed whereas a one way ratchet permits an easily turned action to be employed.

The present invention further contemplates that all rollers will have supports on each end and that the roller will be independently rotatable with respect to each end member. Detent or ratcheting means is provided in one or both of the ends and insures that a roller when wound to bring the hair to the desired tension remains in this wound condition until the roller is manipulated for unwinding.

Terms such as "up," "down," "bottom," "top," "front," "back," "in," "out" and the like are applicable to the embodiments shown and described in conjunction with the drawing. These terms are merely for the purpose of description and do not necessarily apply to the position in which the hair roller assemblies above-described may be constructed or used.

While particular embodiments of the hair roller have been shown and described it is to be understood the invention is not limited thereto and protection is sought to the broadest extent the prior art allows.

What is claimed is:

1. A hair roller assembly having independently rotatable end supports with at least one of the end supports restricted as to the freedom of rotation, said roller assembly including: (a) an intermediate roller member of generally cylindrical configuration; (b) a closed end member of disc-like configuration secured to each of the ends of the intermediate roller member so as to seat in and close the open end; (c) a short axle rotatably carried in each of the closed end members, said axle independently movable with respect to the other axle; (d) a support member carried by the axle, each support member independently movable with respect to the other support member, each support member formed with a broad base support portion adapted to rest on the hair of the user's head and while in resting condition lifting the roller sufficiently for the hair of the user to be wound on the intermediate roller member while said member is being rotated on the axles; (e) at least one ratchet gear carried by one of the closed end members and the associated end of the roller member, and (f) a ratchet engaging pawl carried by and with the support member and moved as the support member moves in an arch around the axis of the intermediate roller member, this pawl adapted to prevent rotating of the roller with the hair thereon it until the desired tension has been developed in the hair wound on the roller after which the rotation of the intermediate roller is terminated with the pawl engaging this ratchet gear and preventing unwanted reverse rotation of the roller.

2. A hair roller assembly as in claim 1 in which the ratchet gear has internally directed teeth and in engaging relationship with the teeth of said gear is a ratchet arm having one end fixedly secured to the axle, the other end of the ratchet arm having a gear tooth engaging portion disposed to seat in and engage a tooth portion of the ratchet gear to permit only one-way movement thereof, the ratchet arm including a bias means permitting said tooth engaging portion to be cammed from its seated engagement of the tooth portion of the gear and to move to seating engagement with the next adjacent tooth portion of the gear.

3. A hair roller assembly as in claim 1 in which the ratchet gear has externally directed teeth and in engaging relationship with the teeth of said gear is a ratchet arm having one end fixedly secured to a supporting means, the other end of the ratchet arm having a gear tooth engaging portion disposed to seat in and engage a tooth portion of the ratchet gear to prevent movement thereof, the ratchet arm and support thereof including a bias means permitting said tooth engaging portion to be cammed from its seated engagement of the tooth portion of the gear and to move to seating condition with the next adjacent tooth portion of the gear.

4. A hair roller assembly as in claim 1, in which the intermediate roller member is a conventional roller having substantially open ends and into these open ends are fixedly mounted end plates which carry the restrictive ratchet means as well as the axle by which the associated end member is carried.

5. A hair roller assembly as in claim 2 in which the ratchet gear is carried by the intermediate roller member and the ratchet arm is fixed to the associated end member.

6. A hair roller assembly as in claim 3 in which the ratchet gear has teeth formed so as to provide a "one-way" rotation in association with the ratchet arm which then becomes a pawl.

7. A hair roller assembly as in claim 4 in which the end plate has an annular ring portion which is a press fit with a mating diameter end portion of the intermediate roller member and this end plate has a stop shoulder by which is established a limit to the amount of engagement of the annular ring portion, the annular ring aligning the end plate to establish the attitude of the end member to the axis of the intermediate roller member.

8. A hair roller assembly as in claim 6 in which the ratchet gear is carried by the intermediate roller member and the ratchet arm is fixed to the associated end member.

9. A hair roller assembly as in claim 8 in which the ratchet arm is carried on a spring portion of the end member support and there is provided manipulating means for selectively disengaging the gear engaging portion from the gear tooth.

* * * * *